United States Patent [19]

Christianson

[11] 4,257,909

[45] Mar. 24, 1981

[54] NON-AROMATIC HYDROCARBON CONTAINING CLEANING FLUID

[75] Inventor: Erik F. S. Christianson, Sonderborg, Denmark

[73] Assignee: Danfoss A/S, Nordborg, Denmark

[21] Appl. No.: 108,451

[22] Filed: Dec. 28, 1979

Related U.S. Application Data

[63] Continuation-in-part of Ser. No. 87,630, Oct. 23, 1979, which is a continuation of Ser. No. 942,764, Sep. 15, 1978, abandoned.

[30] Foreign Application Priority Data

Sep. 26, 1977 [DK] Denmark ..... 04235/77

[51] Int. Cl.[3] ..... C11D 1/71; C11D 1/825; C11D 7/50

[52] U.S. Cl. ..... 252/170; 252/162; 252/171; 252/174.21; 252/351

[58] Field of Search ..... 252/89.1, 162, 167, 252/170, 171, 312, 351, 356

[56] References Cited

U.S. PATENT DOCUMENTS

| | | | |
|---|---|---|---|
| 1,558,299 | 10/1925 | Schwartz | 260/410.8 |
| 2,584,994 | 2/1952 | Filachione et al. | 260/410.8 |
| 2,745,749 | 5/1956 | Feuge et al. | 260/410.8 X |
| 3,737,387 | 6/1973 | Marple | 252/170 |
| 3,745,125 | 7/1973 | Marranci et al. | 252/312 |
| 4,093,418 | 6/1978 | Compton et al. | 8/143 |

FOREIGN PATENT DOCUMENTS

| | | | |
|---|---|---|---|
| 2097333 | 3/1972 | France | 252/170 |
| 30384 | 9/1973 | Japan | 252/170 |
| 373331 | 6/1973 | U.S.S.R. | 252/170 |

*Primary Examiner*—P. E. Willis, Jr.
*Attorney, Agent, or Firm*—Wayne B. Easton

[57] ABSTRACT

The invention relates to a cleaning fluid essentially consisting of aliphatic or saturated liquid hydrocarbons and an ethoxylate. The cleaning fluid is a three-phase system consisting of a liquid hydrocarbon which is poor in aromatic content, a wetting agent such as alkyl aryl ethoxylate or alkyl ethoxylate as the second phase, and between the two phases, which are inter-indissoluble, a linking agent consisting of diesterfield monoglycerides of fatty saturated or unsaturated acids. The result is a well-wetting fluid which is poor in aromatic content and does not have an offensive odor but does have a good linking of the hydrocarbon by means of a linking agent which does not cause any inconvenience in the form of skin injuries, eczema or the like.

3 Claims, No Drawings

NON-AROMATIC HYDROCARBON CONTAINING CLEANING FLUID

CROSS REFERENCE TO RELATED APPLICATION

This application is a continuation-in-part application of my application Ser. No. 87,630, filed Oct. 23, 1979, which is a continuation of Ser. No. 942,764, filed Sept. 15, 1978, now abandoned.

The invention relates to a cleaning fluid essentially consisting of aliphatic or saturated liquid hydrocarbons and an ethoxylate.

Such already known cleaning fluids generally consist of hydrocarbons, e.g. turpentine, petroleum, kerosine or the like. Such fluids have had ethoxylates admixed. The ethoxylates are fully soluble in such fluid and act as a wetting agent. Such cleaning fluid has the drawback that it has an offensive odor and causes respiratory discomfort, mostly because of the aromatic content of the hydrocarbon, and may also affect health as it may cause skin injuries, e.g. oil eczema, through excessive degreasing and drying of the skin. Consequently, premises where such fluid is used must for reasons of health, be equipped with air exhaust.

Some of these drawbacks can be eliminated through the use of non-aromatic or almost non-aromatic hydrocarbons, but as it is difficult—not to say impossible—to dissolve an ethoxylate in an oleophilic fluid, the solution of the problem is the application of a linking agent. However, linking agents otherwise suggesting themselves, such as a sulphonate or "synthetic detergent," are unsuitable for reasons of health, causing inconveniences such as extreme degreasing of the skin and often oversensitive reactions.

According to the invention this problem is solved when the cleaning fluid is a three-phase system consisting of a liquid hydrocarbon which is poor in aromatic content, a wetting agent such as alkyl aryl ethoylate or alkyl ethoxylate as the second phase, and between the two phases, which are interindissoluble, a linking agent consisting of diesterfied monoglycerides of the fatty saturated or unsaturated acids. Products made of e.g. petroleum; liquid petroleum products in particular kerosene; or turpentine; by extraction of substantially all the aromatic components thereof, e.g. by furfural (furfurol) or by hydrogenation of the aromatic components thereof can be used as the first phase. Thus petroleum, kerosene or other liquid products made from petroleum, or turpentine can be used as the first phase, provided substantially all the aromatic components have been eliminated therefrom. The hydrocarbons that can be used as the first phase are those which are liquid at room temperature and pressure.

The result is a well-wetting fluid which is poor in aromatic content and does not cause smelling inconvenience, plus a good linking of the hydrophilic substances and the hydrocarbon by means of a linking agent which does not cause any inconvenience in the form of skin injuries, eczema or the like.

It is particularly advantageous to use diesterfied monoglycerides of the fatty saturated and unsaturated acids containing 8 to 10 carbon atoms and in which the esterifying groups are selected from acetate, propionate and butyrate as the third phase. Further, the amount of linking agent is desirably about 3 to 8 percent by weight, based on the total weight of the composition of this invention.

According to the invention, a very economical compound is obtained when diesterfied monoglycerides of the lauric acid is used.

An advantageous proportion of ingredients is 1 percent of alcohol ethoxylate and 3 percent of diesterfied monoglycerides of the lauric acid. This compound has the additional property of being water-displacing.

According to the invention it will be expedient to add a rust inhibitor. Such additive is required in very small quantities only (500 to 1000 ppm).

A cleaning fluid according to the invention can consist of a three-phase system consisting of a liquid hydrocarbon which is poor in aromatic content as the first phase; a wetting agent—alkyl aryl ethoxylate or alkyd ethoxylate—as the second phase, and diesterfied monoglycerides of fatty acides are used as a linking agent between the phases, which are inter-indissoluble. This eliminates inconvenience because a hydrocarbon which is poor in aromatic is used, and the advantage is that the additives are fully indissoluble without affecting health or causing smelling inconvenience.

A compound according to the invention can, e.g., consist of an almost non-aromatic petroleum in which has been dissolved 1 percent of ethoxylate, e.g. Skell's Dobanol in a non-aromatic petroleum, e.g. Skellsol-Kor Exsol or D80 To this is added 6 to 8 percent of a linking agent of diesterfied monoglycerides of oleric acid. A more economical compound is obtained if diesterfied monoglycerides of lauric acid are used because then the advantage is that the quantity of linking agent can be reduced to 3 percent so that the compound consists of 3 percent of linking agent, 1 percent of Dobanol dissolved in almost non-aromatic petroleum or non-aromatic turpentine.

These liquids have the further property of being water-displacing. If extra rust inhibitation is desired, small quantities of a rust inhibitor can be added to the fluid, e.g. an already known anti-rust additive such as 500 ppm of primary amines or benzotriazole. The said compound has the additional advantage of water-displacing or self-displacing, i.e. that it is water-separating on standing so that the cleaning fluid will float on top of the water in the tank.

What is claimed is:

1. In a cleaning fluid consisting essentially of a liquid hydrocarbon and a small amount of an alkyl-or alkaryl-ethoxylate as a wetting agent, the improvement which comprises utilizing as the hydrocarbon a liquid hydrocarbon which is substantially free from aromatic components and incorporating into the composition, as a linking agent for the hydrocarbon and the wetting agent, from 3 to 8 percent by weight, based on the total weight of the composition, of a diester of a monoglyceride of a saturated or unsaturated fatty acid containing from 8 to 18 carbon atoms and in which the esterifying groups are selected from acetate, propionate and butyrate.

2. In a cleaning fluid consisting essentially of a liquid hydrocarbon and a small amount of an alkyl-or alkaryl-ethoxylate as a wetting agent, the improvement which comprises utilizing as a hydrocarbon selected from the group consisting of liquid petroleum, liquid petroleum products and turpentine that are substantially free from aromatic components and incorporating into the composition, as a linking agent for the hydrocarbon and the wetting agent, from 3 to 8 percent by weight, based on the total weight of the composition, of a diester of a monoglyceride of a saturated or unsaturated fatty acid containing from 8 to 18 carbon atoms and in which the esterifying groups are selected from acetate, propionate and Butyrate.

3. The composition of claim 2 wherein the hydrocarbon is a kerosene product that is substantially free of aromatic components.

* * * * *